United States Patent [19]

Forsythe et al.

[11] Patent Number: 4,621,990

[45] Date of Patent: Nov. 11, 1986

[54] DIAPHRAGM PUMP

[75] Inventors: Carl Forsythe, Tulsa; Jon L. Dorminy, Sand Springs; Joseph W. Raymon, Skiatooth, all of Okla.

[73] Assignee: The Gorman-Rupp Company, Mansfield, Ohio

[21] Appl. No.: 707,460

[22] Filed: Mar. 1, 1985

[51] Int. Cl.[4] ..... F04B 43/06

[52] U.S. Cl. ..... 417/395

[58] Field of Search ..... 417/392, 395; 267/170, 267/177

[56] References Cited

U.S. PATENT DOCUMENTS

| | | | |
|---|---|---|---|
| 983,729 | 2/1911 | Laidley | 417/395 |
| 1,381,562 | 6/1921 | Jones | 417/392 |
| 1,445,497 | 2/1923 | Dixon | 417/392 |
| 1,767,354 | 6/1930 | Eastes | 417/392 |
| 2,540,265 | 2/1951 | James | 267/170 X |
| 3,814,548 | 6/1974 | Rupp | 417/395 |
| 3,816,034 | 6/1974 | Rosenquest, Jr. | 417/395 |

*Primary Examiner*—Leonard E. Smith

*Attorney, Agent, or Firm*—Watts, Hoffmann, Fisher & Heinke Co.

[57] ABSTRACT

A diaphragm pump with mechanical return stroke assist. The pump includes a flexible diaphragm within a pump housing which is driven by a pressurized fluid during a power stroke and returned to an initial position during a return stroke. The mechanical assist includes a spring and metal rod attached to the diaphragm. During the power stroke the spring stretches and stores potential energy that is released as the tensioned spring and tension rod pull the diaphragm back to an initial position during the return stroke.

6 Claims, 4 Drawing Figures

DIAPHRAGM PUMP

DESCRIPTION

1. Technical Field

The present invention relates generally to pumps, and more specifically to a new air operated, spring assisted diaphragm pump.

2. Background Art

A diaphragm pump operates by controlled application of fluid pressure against a diaphragm mounted within a pump housing. Each pumping cycle consists of a power stroke and a return stroke of the diaphragm. During the power stroke, the diaphragm exerts a pumping force against fluid within the housing causing fluid flow through the housing outlet. On the return stroke, the diaphragm is returned to an initial position to complete a cycle, while the housing is filled with fluid.

Diaphragm pumps have been provided with spring devices associated with the diaphragm that store energy during the power stroke and assist in the return stroke. A typical pump construction of this type is described in U.S. Pat. No. 3,816,034. The pump disclosed in this patent includes a rod that extends from the center of the diaphragm and is surrounded by compression springs mounted in a long tube projecting above the pump housing. The rod acts to compress the springs during the power stroke, and the springs, acting through the rod, assist in the return stroke of the diaphragm.

There are many disadvantages associated with the use of compression springs as a means for assisting in the return stroke of the diaphragm. Compression springs are commercially available only in relatively short lengths, e.g., about eight inches. In order to achieve the loading and length of stroke required in a diaphragm pump, it is necessary to stack several of the short springs end-to-end in the spring tube. For example, a typical two inch diameter diaphragm pump has four compression springs end-to-end. During the power stroke, the several springs move laterally in different directions as they are compressed. This movement causes the springs to hit and rub against the wall of the spring tube. In addition, the spring rod is caused to wobble during movement which results in undue bushing wear and tearing of the diaphragm.

The forces exerted by compression springs vary widely from spring to spring because of the way that they are manufactured. Consequently, it is necessary to preload the springs when they are assembled in the spring tube. In a typical diaphragm pump, the spring preloading force is on the order of 1650 pounds. This high preload force is hard to achieve, particularly in a multiple spring arrangement, so that assembly of the pump is a difficult operation. The multiple spring arrangement and the high preload force also make it difficult and dangerous to disassemble the pump when it becomes necessary to replace the diaphragm.

The required preloading of the compression springs leads to several other problems. Because the assembly operation is difficult, it must be done at the factory and the pump shipped in a fully assembled condition. The spring tube of a typical compression spring assist diaphragm pump is about 105 inches long. The difficulties and expense of crating and shipping such a pump without damage are apparent.

The required preloading force can stress the typical compression spring to a level of 90% or more of its ultimate tensile strength. This fact together with the fact that the springs are loaded even when the diaphragm is at rest in its return position, result in a short spring life so that maintenance costs are high.

Still another disadvantage of the compression spring assist diaphragm construction is that positive stops are required to limit the travel of the diaphragm. In the usual construction, plates above and below the diaphragm hit the top and bottom of the pump housing. This leads to further wear and maintenance problems.

DISCLOSURE OF INVENTION

An object of the present invention is to provide a new spring assist diaphragm pump which overcomes the many problems inherent in prior art pumps which feature the use of compression springs. The new pump construction incorporates a tension rod and extension spring assembly which is arranged to facilitate assembly and maintenance operations and to improve the expected pump life and performance.

A preferred embodiment of the invention comprises a tension rod which is connected to the center of the diaphragm and extends into a short spring housing. A simple extension spring is mounted between the top of the rod and the top of the spring housing. In use, the extension spring is lengthened during the power stroke to store energy. The extension spring assists in returning the diaphragm to its initial position in which the spring is in a relaxed or unstressed condition.

The new pump construction of the invention is characterized by an extended life compared to prior art constructions such as described above. This is due in part to the fact that, because of its inherent design features, a tension spring lasts longer than a compression spring when embodied in a diaphragm pump. More particularly, a tension spring can be manufactured to create the desired loading, e.g., 1650 pounds, without unduly stressing the spring beyond 50 to 60% of its ultimate tensile strength. Another feature of construction responsible for improved pump life is the absence of any preloading force whatsoever. With the diaphragm in its return position, the tension spring is in a relaxed condition, i.e., there is no imposed stress.

Since the extension spring is not required to be preloaded, the new pump of the invention is much easier and safer to assemble and repair than pumps embodying preloaded compression springs. A related advantage is that it is not necessary to assemble the spring assist structure at the factory. Instead, the spring, tension rod and spring housing can be conveniently crated and shipped in an unassembled condition to the user. The operation of connecting the rod to the diaphragm, mounting the spring and rod assembly in the spring housing, and finally attaching the spring housing to the top of the pump housing can be quickly and easily carried out by the user.

The preferred construction of the new pump does not require positive stops inside of the pump housing for limiting movement of the diaphragm. The extreme down position of the diaphragm during the power stroke is defined by a collar on the tension rod. The return position of the diaphragm is defined by the length of the extension spring. The elimination of positive diaphragm stops inside of the pump housing reduces wear and minimizes operational noise.

The length of the tension rod and the length of spring housing can be made considerably shorter than the components of compression spring assist diaphragm pumps. The shorter rod length reduces tearing of the diaphragm due to lateral rod movement. Further, the new pump with the shorter spring housing provides for a more convenient installation.

Other features and advantages and a full understanding of the invention will be had from the following detailed description and the accompanying drawings.

BEST MODE FOR CARRYING OUT THE INVENTION

Figure 4:
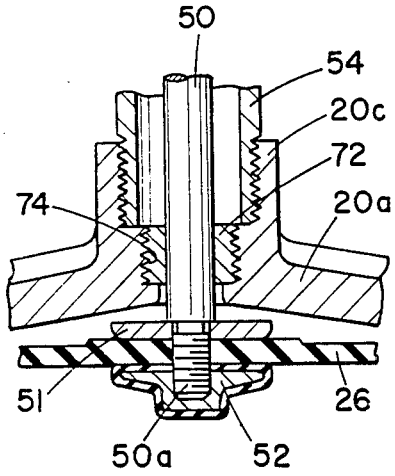
FIG. 4 is an enlarged sectional elevation view of another portion of the pump.
Figure 1:
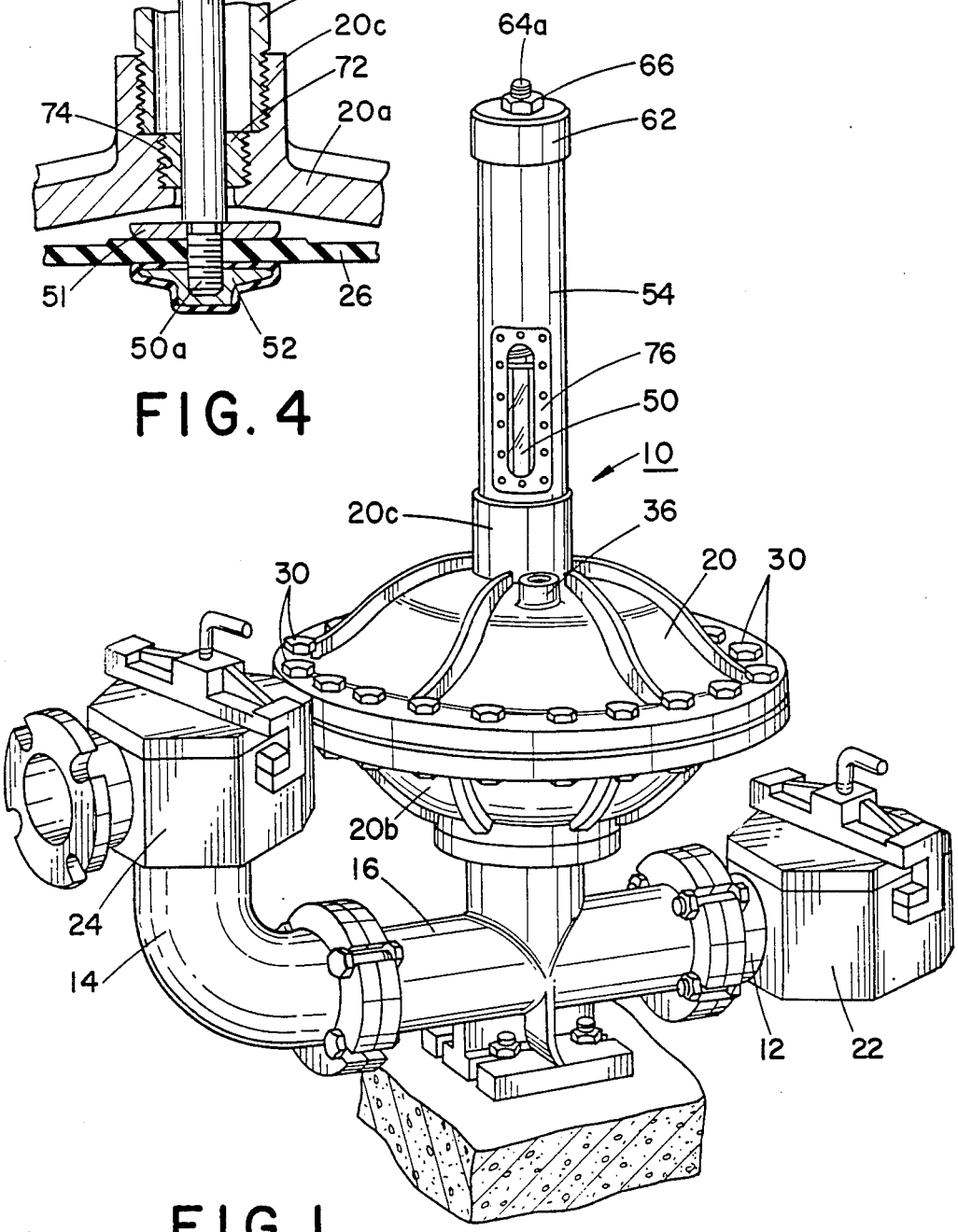
FIG. 1 is a perspective view of a diaphragm pump of the present invention.
Figure 3:
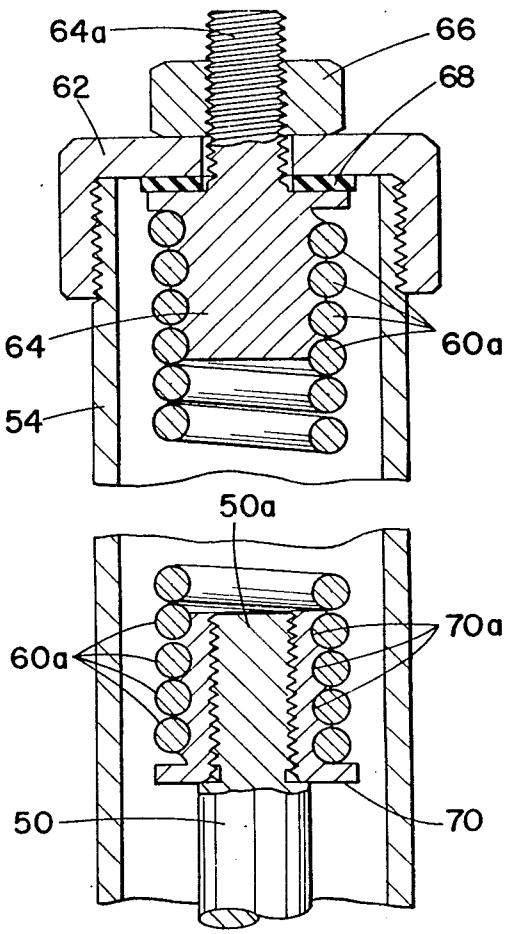
FIG. 3 is an enlarged sectional elevation view of a portion of the pump.

Referring to the drawings, reference numeral 10 generally designates the diaphragm pump of the present invention. As shown, an inlet pipe 12 and outlet pipe 14 direct fluid through a tee 16 coupled to a pump housing 20. Two check valves 22, 24 allow fluid flow in a direction indicated by the arrow 25 in FIG. 2 in response to pressure exerted upon fluid within the pump housing 20 by a flexible pump diaphragm 26.

Figure 2:
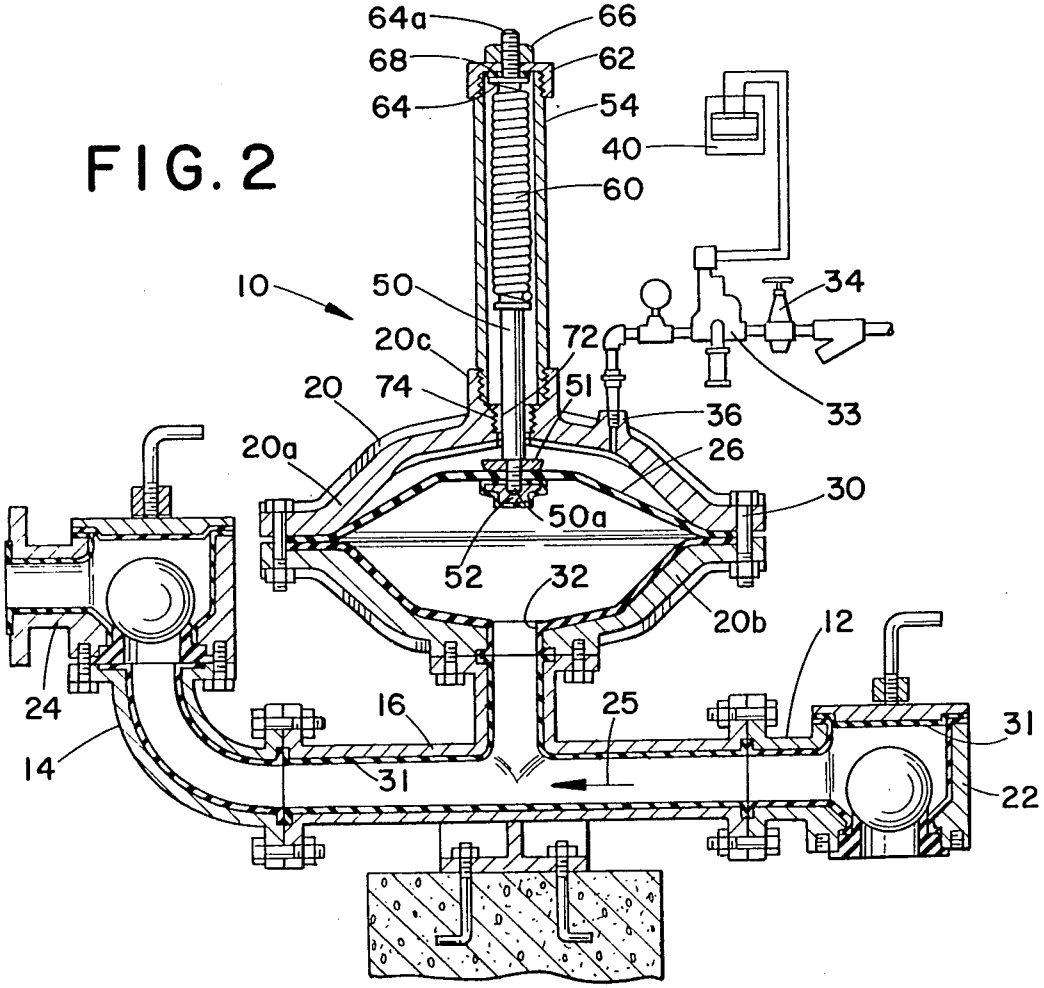
FIG. 2 is a sectional elevation view of the pump shown in FIG. 1.

The pump housing 20 comprises two body portions 20*a*, 20*b* which are connected by bolts 30. In addition to holding the body portions 20*a*, 20*b* together, the bolts 30 also secure the pump diaphragm 26 within the pump housing. The housing 20 includes a fluid inlet 32 mated with a flanged portion of the tee 16. The diameter of the inlet 32 is variable with the particular application, but it should be noted the pump includes no constricted region narrower than the inlet 32. As seen in FIG. 2 the check valves 22, 24, the tee 16 and the housing 20 are protected from corrosion by a liner 31. Suitable liner materials include Hypalon, Neoprene, Nordel, Fluorel, and Viton.

In FIG. 2 the pump diaphragm 26 is shown in a retracted position prior to the power stroke that initiates a pump cycle. During the power stroke, a solenoid valve 33 is opened to allow pressurized air regulated by a pressure regulator 34 to pass through a high pressure inlet 36 in the pump housing 20. The time period that pressurized air is routed through the inlet 36 to the pump diaphragm 26 is regulated by a control timer 40 schematically illustrated in FIG. 2. During the time in which the solenoid valve 32 is open, pressurized air forces the diaphragm away from the position shown in FIG. 2 to exert a pumping force against fluid within the housing chamber. This pressure in combination with the operation of the two check valves causes fluid flow in the direction indicated.

A tension rod 50 is connected near the center of the generally circular diaphragm 26. A threaded rod stem 50*a* passes through an opening in the center of the diaphragm 26 so that the rod 50 can be secured to the diaphragm 26 by upper and lower diaphragm retention plates 51, 52 that engage the threaded rod stem 50*a*. These retention plates 51, 52 reduce bending and stretching of the diaphragm during pumping. An inner plate 52 is lined with one of the suitable lining materials mentioned above to prevent corrosion.

A cylindrical housing 54 threaded at both ends engages a housing collar 20*c* and extends upwardly away from the pump housing 20. The cylindrical housing 54 supports both the rod 50 and an extension spring 60 which pulls the diaphragm 26 back to the position shown in FIG. 2 after each power stroke.

A spring housing cap 62 is threaded on the upper end of the housing 54 and supports the spring 60 by means of an upper spring retaining plug 64. The plug 64 is secured to the cap 62 by a retaining nut 66 which engages a threaded stem 64*a* of the plug 64. The top plug 64 has a series of peripheral recesses or grooves into which individual coils 60*a* of the spring 60 seat. These coils 60*a* remain stationary as the spring 60 is extended during the power stroke. An annular compression seal 68 is provided between the cap 62 and plug 64 to prevent pressurized air from escaping from the spring housing 54.

A lower spring plug 70 connects the spring 60 to the rod 50. This plug 70 also has a series of peripheral recesses 70*a* into which the end most spring coils 60*a* seat. The lower spring plug 70 has a threaded hole that receives a stem portion 50*a* of the rod 50. Downward movement of the rod 50 during the pumping stroke of the diaphragm 26 extends the spring 60 and stores potential energy that helps retract the diaphragm on the return stroke.

The spring 60 aligns the rod 50 within the housing 54. This reduces wear on an annular rod guide or bushing 72 that spaces the rod from a housing aperture 74 inside the collar 20*c*. The rod guide 72 is threaded on an outside surface and engages a correspondingly threaded inside surface of the housing aperture 74.

The housing 50 includes a stroke length indicator 76 which allows the user to visually inspect pump operation by observing up and down movement of the rod 50. In the event pump operation, as viewed through the indicator 76, needs adjusting, the pressure regulator 34 and/or the timer 40 can be reset until observed pump operation reaches a desired state.

The construction of the spring housing 54 and pump housing 20 facilitates installation and maintenance of the pump 10. The two housings 20, 54 are shipped to the user disconnected. The threaded spring housing 54 is installed after the rod guide 72 is threaded into the housing collar 20*c*, the rod 50 inserted through the guide 72 and the rod stem 50*a* pushed through the diaphragm and secured with the diaphragm retention plates 51, 52. The lower plug 70 is then threaded onto the rod 50 and the spring 60 is threaded onto the plug 70. At an upper end of the spring, the plug 64 and seal 68 are installed and then the housing 54 slipped over the vertically oriented spring 60 and threaded into the housing collar 20*c*. Finally the cap 62 is threaded onto the housing 54 and the nut 66 tightened to compress the seal 68. The spring is not tensioned so the task of making these connections can be safely performed by the user. If maintenance is required or the spring must be replaced, the nut 66 and cap 62 are removed and the spring housing 54 can be safely disconnected from the housing 20.

In operation, each pumping cycle begins with pressurized air impinging on the diaphragm 26. This drives the diaphragm down into the pump housing 20 and stretches the spring 60 storing energy to aid diaphragm movement on a return stroke. The check valves 22, 24 limit fluid flow to the direction of the arrow 25 in response to the pressure of the diaphragm. Downward movement of the rod 50 is limited when a flange on the lower spring plug 70 contacts the rod guide 72 before the plate 52 can contact the housing portion 20*b*.

When the solenoid valve 33 is closed, the combination of fluid pressure on the pump diaphragm 26 and the restoring force of the spring 60 retracts the diaphragm 26. An upward travel limit is defined by the length of the rod and unstretched spring. The combined length of the spring 60 and the rod 50 is such that the plate 51 never contacts the top housing portion 20*a*. Pumping continues with cyclic opening and closing of the valve 33 at a frequency and duration controlled by the timer 40. These pumping characteristics can be adjusted by the user depending upon the type of fluid being pumped as well as observed operation of the pump.

The diaphragm pump 10 has been described with a degree of particularity. It is the intent, however, that the invention include all modifications and/or alterations falling within the spirit or scope of the appended claims.

We claim:

1. In a spring assist, air operated diaphragm pump including a pump housing having an inlet and an outlet, a diaphragm mounted in said pump housing for movement through a power stroke and a return stroke as pressurized air is cycled into and out of said housing, the improvement comprising a spring tube connected to said housing, a tension rod connected to said diaphragm and projecting into said tube, and a spring interposed between said rod and said housing, whereby said spring is tensioned during the power stroke of said diaphragm and serves to assist movement of said diaphragm during its return stroke and further wherein said spring is free of loading stress when said diaphragm is at the end of its return stroke.

2. The improvement as claimed in claim 1 including plate means carried by said rod for connecting said rod to said diaphragm, wherein the combined length of the rod and unstretched spring is such that said plate means is spaced from the inner surface of said housing when said diaphragm is at the end of its return stroke.

3. The improvement as claimed in claim 1 including abutment means carried by said rod in said tube for limiting the power stroke of said diaphragm.

4. In a pump having a flexible diaphragm mounted in a pump housing to exert a pumping force on a fluid within the housing, apparatus for cyclically moving the diaphragm within the housing comprising:

means for cyclically routing a pressurized fluid through an opening in said housing to contact a diaphragm surface and exert a drive force on said diaphragm during a power stroke;

a rigid rod connected to said diaphragm for exerting a cyclic return force on the diaphragm;

a cylindrical spring housing connected to the pump housing to orient the rod for back and forth movement through an aperture in the pump housing during the pump power and return strokes; and a spring having one end connected to the spring housing and an opposite end connected to the rod so that movement of the diaphragm during the power stroke tensions the spring to store energy which is released during a pump stroke tensions the spring to store energy which is released during a pump return stroke as the spring exerts a return force on the rod;

said pump housing defining an opening for passage of the rod having a first threaded portion to accept a correspondingly threaded rod guide and a second threaded portion to receive a correspondingly threaded portion of the cylindrical spring housing.

5. The diaphragm pump of claim 4 wherein the rod guide comprises an annular sleeve for positioning the rod as it passes through the opening in the pump housing.

6. The diaphragm pump of claim 4 additionally comprising a spring housing end cap for supporting the spring and rod in said cylindrical spring housing, and two spring connectors, one connector for connecting the housing end cap to the spring and one for connecting the spring to said rod.

* * * * *